US008833800B2

(12) United States Patent
Meyer et al.

(10) Patent No.: US 8,833,800 B2
(45) Date of Patent: Sep. 16, 2014

(54) CONTINUOUS DESK PAD

(75) Inventors: Megan M. Meyer, Waxhaw, NC (US); Thomas J. Africa, Lebanon, OH (US); Sherry L. Jones, Pataskala, OH (US); Edward P. Busam, Mason, OH (US); Lisa K. Brooks, West Chester, OH (US); Danielle L Osborne, Dayton, OH (US)

(73) Assignee: Acco Brands Corporation, Lincolnshire, IL (US)

( * ) Notice: Subject to any disclaimer, the term of this patent is extended or adjusted under 35 U.S.C. 154(b) by 0 days.

(21) Appl. No.: 13/395,967

(22) PCT Filed: Sep. 1, 2010

(86) PCT No.: PCT/US2010/047424
§ 371 (c)(1),
(2), (4) Date: Mar. 14, 2012

(87) PCT Pub. No.: WO2011/059548
PCT Pub. Date: May 19, 2011

(65) Prior Publication Data

US 2012/0175865 A1 Jul. 12, 2012

Related U.S. Application Data

(60) Provisional application No. 61/260,964, filed on Nov. 13, 2009.

(51) Int. Cl.

| | |
|---|---|
| ***B42D 5/04*** | (2006.01) |
| ***B42D 5/06*** | (2006.01) |
| ***G09D 3/04*** | (2006.01) |

(52) U.S. Cl.
CPC ..... *G09D 3/04* (2013.01)
USPC ..... 283/2; 40/118; 40/121

(58) Field of Classification Search
CPC ..... B42D 5/04; B42D 5/06; B42D 5/065
USPC ..... 283/2; 40/118–119, 121; D19/20
See application file for complete search history.

(56) References Cited

U.S. PATENT DOCUMENTS

| | | | | |
|---|---|---|---|---|
| 1,432,504 | A | | 10/1922 | Vivian |
| 1,464,191 | A | | 8/1923 | West |
| 1,519,643 | A | * | 12/1924 | Van Arsdale ..... 283/2 |
| 1,594,665 | A | | 8/1926 | Dana |
| 1,716,600 | A | | 6/1929 | Rehder |

(Continued)

FOREIGN PATENT DOCUMENTS

| | | | |
|---|---|---|---|
| FR | 1226001 | * | 7/1960 |
| WO | WO9800052 A2 | | 1/1998 |
| WO | WO0136193 A1 | | 5/2001 |

OTHER PUBLICATIONS

Translation of FR1226001 (Jul. 1960).*

(Continued)

*Primary Examiner* — Kyle Grabowski
(74) *Attorney, Agent, or Firm* — Thompson Hine LLP

(57) ABSTRACT

The present invention provides a calendar desk pad, comprising a base member, a plurality of monthly calendar pages bound to the base member, wherein the calendar pages have at least one perforation or fold line located between the days or weeks on the calendar.

9 Claims, 2 Drawing Sheets

(56) References Cited

U.S. PATENT DOCUMENTS

| | | | | | |
|---|---|---|---|---|---|
| 2,469,177 | A | | 5/1949 | Ruffner | |
| 2,722,071 | A | * | 11/1955 | Paschal | 40/121 |
| 2,731,746 | A | | 1/1956 | Newman | |
| 2,787,071 | A | | 4/1957 | Friedman | |
| 3,731,415 | A | | 5/1973 | Shore | |
| 4,531,314 | A | * | 7/1985 | Parent et al. | 40/119 |
| 4,793,634 | A | | 12/1988 | Alloggiamento | |
| 4,798,402 | A | * | 1/1989 | Pazicni | 283/2 |
| 5,222,052 | A | | 6/1993 | Salame | |
| 5,329,711 | A | * | 7/1994 | Dewey | 40/119 |
| 5,339,546 | A | | 8/1994 | Rahwan | |
| 5,661,918 | A | | 9/1997 | Malcolm et al. | |
| 5,799,423 | A | | 9/1998 | Malino | |
| 6,877,262 | B2 | | 4/2005 | Bianco | |
| 7,093,857 | B2 | | 8/2006 | Martin | |
| 7,246,458 | B2 | | 7/2007 | Ternovits et al. | |
| 2002/0114220 | A1 | | 8/2002 | Cunningham | |
| 2004/0197744 | A1 | | 10/2004 | Basu et al. | |
| 2005/0040070 | A1 | | 2/2005 | Adams | |
| 2005/0241197 | A1 | | 11/2005 | Ternovits et al. | |
| 2006/0059734 | A1 | | 3/2006 | Drie | |
| 2007/0089331 | A1 | | 4/2007 | Howes | |
| 2007/0125925 | A1 | | 6/2007 | Busam et al. | |
| 2007/0147712 | A1 | | 6/2007 | Ozdeger Donovan et al. | |
| 2007/0278783 | A1 | * | 12/2007 | Carpenter | 281/15.1 |
| 2008/0104868 | A1 | | 5/2008 | Drie | |
| 2009/0034845 | A1 | | 2/2009 | Saund | |
| 2009/0096334 | A1 | | 4/2009 | Sward et al. | |
| 2010/0035224 | A1 | | 2/2010 | Minard | |

OTHER PUBLICATIONS

International Search Report and International Preliminary Report for PCT/US10/047424, Oct. 29, 2010.

"Dataday" calendar photo. Also "Dataday" advertisement. Advertisement downloaded from Internet on Mar. 20, 2012.

* cited by examiner

CONTINUOUS DESK PAD

REFERENCE TO RELATED APPLICATION

This application is a National Phase application of PCT Application PCT/US10/047424, filed Sep. 1, 2010, which claims the benefit of priority under 35 U.S.C. §119(e) of provisional application Ser. No. 61/260,964 filed on Nov. 13, 2009 each of which is hereby incorporated by reference in their entirety.

FIELD OF THE INVENTION

The present invention relates generally to desk pads and more particularly a calendar desk pad.

BACKGROUND OF THE INVENTION

The current invention is an improvement on the traditional desk pad calendar. On these calendars it is common to have several pages attached together with a single month on each page. Accordingly a user can only see one month at a time without flipping pages. This inability to see into the next month without remembering to look ahead makes it difficult for the user to remember meetings, appointments, and/or due dates occurring early in the next month. The current invention creates a user friendly calendar that allows the user to remove or fold a portion of the current month from their view after the time period has passed, thus allowing the user to view the upcoming days and/or weeks in the next month.

BRIEF SUMMARY OF THE INVENTION

The present invention provides a calendar desk pad, comprising a base and a plurality of calendar sheets removably attached to the base and lying in stacked, respective planes that overlie the base and a perforated line separating at least one calendar week from the remainder of the page. The present invention also contemplates a calendar desk pad, comprising a base and a plurality of calendar sheets removably attached to the base and lying in stacked, respective planes that overlie the base and a fold line separating at least one calendar week from the remainder of the page. The present invention also contemplates a calendar sheet having a single month on the sheet and having a perforation following at least one week in the month. The present invention also contemplates a calendar sheet having a single month on the sheet and having a fold line following at least one week in the month.

DETAILED DESCRIPTION OF THE INVENTION

Figure 1:
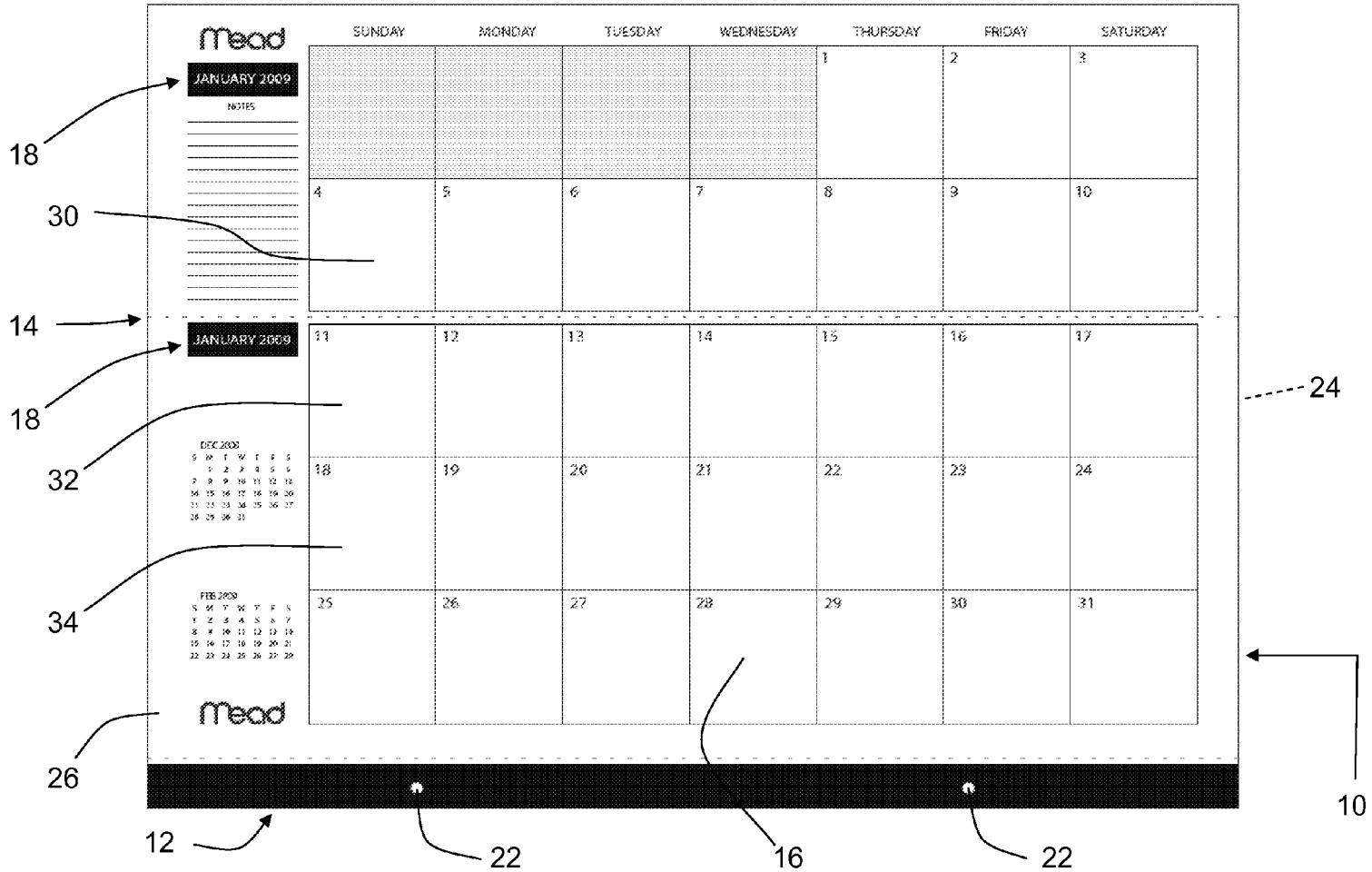
FIG. 1 is a top view of the present invention.
Figure 2:
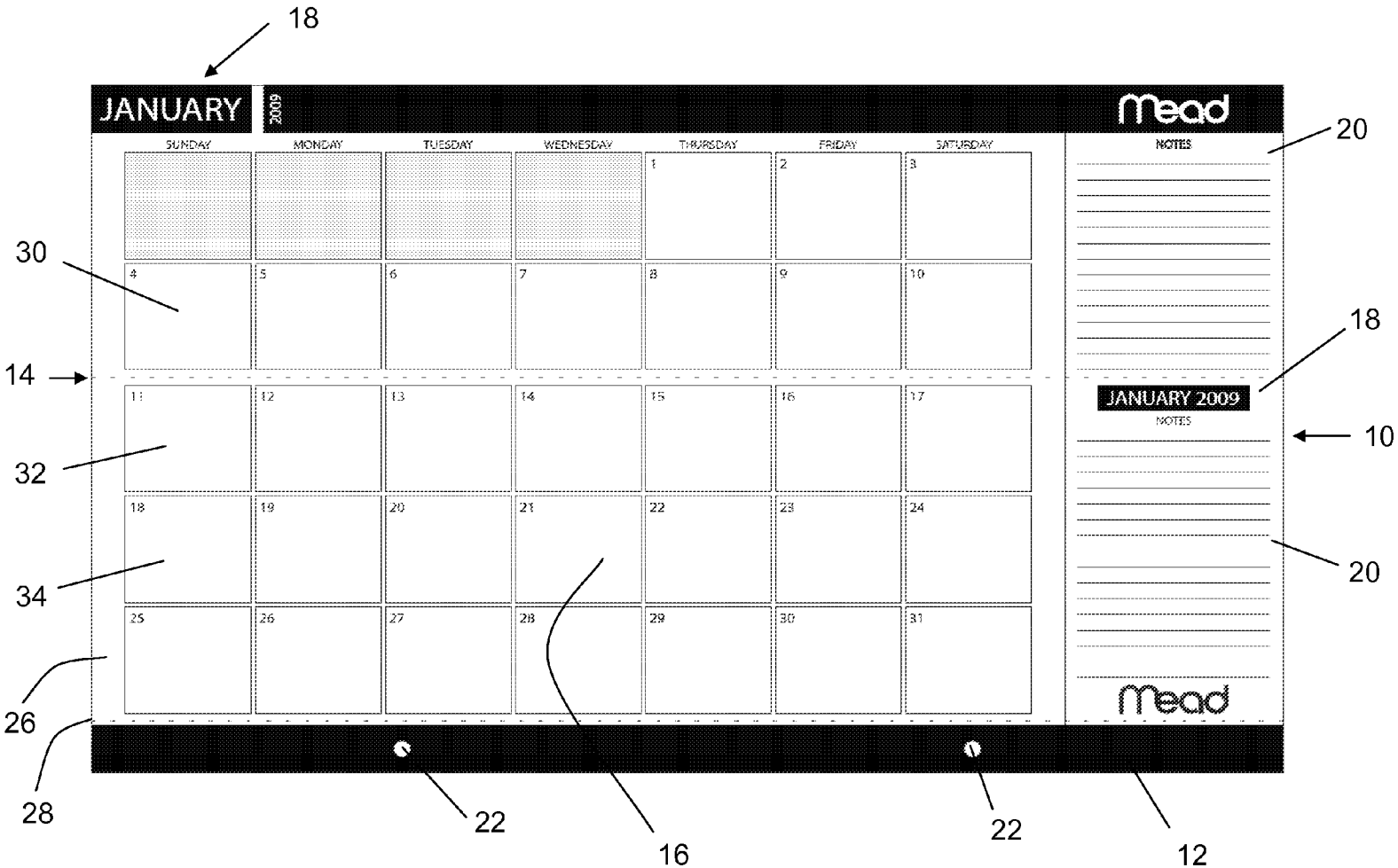
FIG. 2 is a top view of an alternate form of the present invention.

Referring to the figures, the continuous calendar 10 of the current invention may have a plurality of pages 24 bound together on one or more sides by one or more binding mechanism(s) 12 and where the plurality of pages comprise two or more calendar pages 26 and wherein one or more calendar pages 26 may have one or more perforations or fold lines 14 that allow a portion of the page to be removed or folded. The calendar page 26 may have a traditional month calendar format with the month indicator 18 placed in one or more locations of each calendar page 26 and showing each day of the month. Such a calendar page 26 may have a space designated to allow the user to fill in appointments or the like on each day. The desk pad calendar of the present invention may also have one or more spaces 20 on a calendar page to allow the user to write notes or comments. Such calendar page 26 may also have a space to view previous and following months.

The continuous desk pad 10 may have its binding mechanism 12 located across the bottom of the desk pad as compared to the calendar orientation. Such a location may allow the user to more easily remove or fold an upper portion of the calendar page 26 along line 14. Line 14 may be perforated to allow the user to easily remove that portion of the calendar page 26. Line 14 may also be manufactured such that the calendar page 26 creases easily in that location by using score lines. There are a variety of methods to manufacture a removable portion of the page or an easily folded portion of a page. Some methods may include the use of spaced breaks in the page, perforations, holes, weakened spots in the page, embossing, debossing or any combination or these. The appropriate method to use may be determined by manufacturing preferences.

Line 14 may be designed to run parallel to the orientation of the weeks on the calendar page 26. Line 14 may be located beneath the first full week 30 of the month. Line 14 may be located beneath the second full week 32 of the month. Line 14 may be located beneath the third full week 34 of the month. Multiple lines 14 may be placed on each calendar page. The calendar pages 26 may have two or more perforations. The perforations or score lines of line 14 may extend across the majority of calendar sheet 26 to more easily allow the user to fold or separate the top portion of the page.

The calendar page 26 may be removably attached to binding 12. Perforations 28 may be placed along the edge of binding mechanism 12. It is to be understood that score lines could be used in lieu of perforations to allow to user to more easily fold back the pages of the desk pad calendar. In the alternative binding mechanism 12 could be located at two or more corners. The binding mechanism 12 may be cardboard or plastic. Binding mechanism 12 may be comprised of adhesive material, paper, fabric, staples, wire, spiral, tape or stitching. The two or more corner binding mechanism(s) 12 may be triangular, round or any other shape. They may also be paper, wire, staples, adhesive, tape, fabric stitching or any other similar materials or combinations thereof. One or more of the corner binding mechanism 12 may be removably attached, loosely holding the plurality of pages 26 together.

It is to be understood that the desk pad calendar may be of a variety of sizes and shapes based on manufacturing preferences. The desk pad calendar may be rectangular, square, round, oval triangular, star shaped or any other geometric or non-geometric shape. It is to be understood that based on the traditional calendar organization the rectangular shape may have some benefits.

The desk pad calendar could be sized and shaped to be portable. The desk pad may be sized and shaped to fit within a notebook with holes 22 drilled into the binding. In this design it may be preferable to have the perforations 28 or fold line 28 to remove or fold the one or more calendar pages 16 located inside of the holes 22. The calendar itself may be foldable as described in U.S. Publication 20070089331. The benefits of portability would allow a user to easily take the calendar into the classroom or into meetings as needed.

The calendar dimensions could have a height or distance from the one or more binding mechanism(s) 12 to the edge of equal to or less than 10 inches, of equal to or less than 15 inches, of equal to or less than 25 inches, or greater than 25 inches. The desk pad calendar may have a width parallel to the one or more binding mechanism(s) 12 of equal to or less than 10 inches, of equal to or less than 15 inches, of equal to or less than 25 inches, or greater than 25 inches. The desk pad calendar may have a width greater than its height.

It is also to be understood that a calendar sheet could be made that includes the features described previously of the current invention. Namely, the invention contemplates a calendar sheet with a monthly calendar printed thereon and having a fold line 14. The calendar sheet as discussed may have a perforated line 14 which would allow a portion of the calendar sheet to be removed.

It should be understood that changes may be made to the invention described herein without departing from the full scope and spirit of the present invention as set forth in the claims below.

The invention claimed is:

1. A calendar desk pad comprising:

a base;

a plurality of pages removably attached to the base, wherein the plurality of pages comprise two or more calendar pages;

a binding mechanism, which binds the plurality of pages together, wherein the binding mechanism is located across the bottom of the desk pad;

wherein the two or more calendar pages each have at least a first and second perforation and wherein the first perforation is about 60% of the way up the calendar page from the binding mechanism; wherein the calendar page displays a traditional calendar month; and wherein the first and second perforation are located underneath the second full week of the traditional month calendar.

2. The calendar desk pad of claim 1 wherein the binding mechanism is plastic.

3. The calendar desk pad of claim 1 wherein there are more than two perforations on the calendar pages.

4. The calendar desk pad of claim 3 wherein the second perforation is in the bottom third of the calendar closest to the binding mechanism.

5. The calendar desk pad of claim 3 wherein the second perforation is in the bottom half closest to the binding mechanism.

6. A calendar desk pad comprising:

a base;

a plurality of pages removably attached to the base, wherein the plurality of pages comprise two or more calendar pages;

a binding mechanism, which binds the plurality of pages together, wherein the binding mechanism is located at the bottom of the desk pad;

wherein the one or more calendar pages has one or more fold lines or perforation lines oriented generally parallel to the binding mechanism and wherein one of the fold lines or perforation lines is about 60% of the way up the calendar page from the binding mechanism; wherein the calendar page displays a traditional calendar month; and wherein the one or more fold lines or perforations lines are located underneath the second full week of the traditional month calendar.

7. The calendar desk pad of claim 6 wherein there are two or more fold lines or perforation lines on the calendar pages.

8. The calendar desk pad of claim 7 wherein the calendar pages comprise a fold line in the bottom third of the calendar closest to the binding mechanism.

9. The calendar desk pad of claim 7 wherein the calendar pages comprise a fold line in the bottom half closest to the binding mechanism.

* * * * *